US008484986B2

(12) United States Patent
Waibel

(10) Patent No.: US 8,484,986 B2
(45) Date of Patent: Jul. 16, 2013

(54) ENERGY STORAGE SYSTEMS

(75) Inventor: Brian J. Waibel, Kennett Square, PA (US)

(73) Assignee: Phase Change Storage LLC, Newark, DE (US)

( * ) Notice: Subject to any disclaimer, the term of this patent is extended or adjusted under 35 U.S.C. 154(b) by 384 days.

(21) Appl. No.: 13/029,980

(22) Filed: Feb. 17, 2011

(65) Prior Publication Data

US 2011/0204655 A1 Aug. 25, 2011

Related U.S. Application Data

(60) Provisional application No. 61/306,306, filed on Feb. 19, 2010.

(51) Int. Cl.
*F25B 1/00* (2006.01)

(52) U.S. Cl.
USPC ..... 62/115; 62/402

(58) Field of Classification Search
USPC ..... 62/402, 56, 115, 430, 498, 172, 502, 62/DIG. 2
See application file for complete search history.

(56) References Cited

U.S. PATENT DOCUMENTS

| | | | | |
|---|---|---|---|---|
| 4,197,715 | A * | 4/1980 | Fawcett et al. | 62/115 |
| 4,527,618 | A | 7/1985 | Fyfe | |
| 4,609,036 | A | 9/1986 | Schrader | |
| 4,637,219 | A | 1/1987 | Grose | |
| 4,984,432 | A * | 1/1991 | Corey | 62/87 |
| 5,255,526 | A | 10/1993 | Fischer | |
| 5,274,571 | A | 12/1993 | Hesse et al. | |
| 5,384,489 | A | 1/1995 | Bellac | |
| 5,678,626 | A | 10/1997 | Gilles | |
| 5,685,152 | A | 11/1997 | Sterling | |
| 5,819,554 | A * | 10/1998 | Glen | 62/498 |
| 6,158,499 | A | 12/2000 | Rhodes et al. | |
| 6,247,522 | B1 | 6/2001 | Kaplan et al. | |
| 6,260,376 | B1 * | 7/2001 | Khelifa et al. | 62/435 |
| 6,282,907 | B1 * | 9/2001 | Ghoshal | 62/3.7 |
| 6,543,238 | B2 * | 4/2003 | Yamanaka et al. | 62/172 |
| 6,614,109 | B2 * | 9/2003 | Cordes et al. | 257/712 |
| 6,893,902 | B2 * | 5/2005 | Cordes et al. | 438/122 |
| 7,073,338 | B2 * | 7/2006 | Harwood et al. | 62/3.61 |
| 7,124,594 | B2 | 10/2006 | McRell | |
| 7,240,494 | B2 * | 7/2007 | Akei et al. | 62/3.2 |
| 7,363,772 | B2 | 4/2008 | Narayanamurthy | |

(Continued)

FOREIGN PATENT DOCUMENTS

| | | |
|---|---|---|
| WO | 2010/006319 A2 | 1/2010 |
| WO | 2011-103306 | 8/2011 |

OTHER PUBLICATIONS

PCT International Search Report for Application No. PCT/US2011/025267, issued Apr. 19, 2011, 1 page total.

*Primary Examiner* — Mohammad M Ali
(74) *Attorney, Agent, or Firm* — Jennifer L. Wahlsten; Weaver Austin Villeneuve & Sampson LLP

(57) ABSTRACT

The present invention provides an energy storage device that utilizes a cold sink that undergoes cycles of freezing and thawing. The device converts electrical energy to stored thermal energy, and then re-converts the stored thermal energy to electrical energy, as needed or desired. The device can store energy on a large scale (e.g., on the order of megawatts or greater) and for an extended period of time (e.g., for at least 12 hours, or longer, as needed).

48 Claims, 6 Drawing Sheets

U.S. PATENT DOCUMENTS

| | | | | |
|---|---|---|---|---|
| 7,421,846 | B2 | 9/2008 | Narayanamurthy et al. | |
| 7,503,185 | B2 | 3/2009 | Narayanamurthy et al. | |
| 7,823,398 | B2 * | 11/2010 | Glen | 62/172 |
| 2004/0262745 | A1 * | 12/2004 | Cordes et al. | 257/713 |
| 2005/0081557 | A1 | 4/2005 | McCrell | |
| 2005/0178128 | A1 * | 8/2005 | Harwood et al. | 62/3.61 |
| 2007/0151244 | A1 | 7/2007 | Gurin | |
| 2008/0022683 | A1 | 1/2008 | Ohler et al. | |
| 2008/0034760 | A1 | 2/2008 | Narayanamurthy | |
| 2008/0209941 | A1 | 9/2008 | Narayanamurthy | |

* cited by examiner

| | | |
|---|---|---|
| Unit system: | **mks** | K, kPa, kg/m^3, kJ/kg, kJ/kg-K, m/s, uPa-s, W/m-K |
| Storage Cycle Working Fluid: | mks: | **ammonia** |
| Storage Mass Flow Rate: | kg/hr | 33056 |
| | kg/min | 551 |
| | kg/sec | 9.2 |
| COPCs (Qin/Win) | | 7.1 |
| Pressure Ratio (Pmax/Pmin) | | 3.1 |

STORAGE CYCLE

Win1= Compress (3->4)

| | | |
|---|---|---|
| dh= | 156.60 | kJ/kg |
| Power= | 1438.0 | kW |
| | 1928.3 | HP |

Qout1 (Condenser, 4->1)

| | | |
|---|---|---|
| dh= | -1273.82 | kJ/kg |
| Power= | -11696.4 | kW |
| | -39.91 | MBTU/hr |
| | -3326 | Ton |

Qin1 (Evaporator, 2->3)

| | | |
|---|---|---|
| dh= | 1117.21 | kJ/kg |
| Power= | 10258.4 | kW |
| | 35.00 | MBTU/hr |
| | 2917 | Ton |

GENERATION CYCLE

Wout= Expander (7->8)

| | | |
|---|---|---|
| dh= | 35.01 | kJ/kg |
| Power= | -1000 | kW |
| | -1341 | HP |

Win2= Pump (5->6)

| | | |
|---|---|---|
| dh= | 0.40 | kJ/kg |
| Power= | 11.3 | kW |
| | 15.1 | HP |

Qin2 (Vaporize, 6->7)

| | | |
|---|---|---|
| dh= | 393.81 | kJ/kg |
| Power= | 11247.2 | kW |
| | 38.38 | MBTU/hr |
| | 3198 | Ton |

Qout2 (Condense, 8->5)

| | | |
|---|---|---|
| dh= | -359.19 | kJ/kg |
| Power= | -10258.45 | kW |
| | -35.00 | MBTU/hr |
| | -2916.90 | Ton |

Generation Cycle Working Fluid: ISOBUTAN (Isobutane)

| | | |
|---|---|---|
| Generation Mass Flow Rate: | kg/hr | 102815 |
| | kg/min | 1714 |
| | kg/sec | 28.6 |
| COPHg (Qout2/Wout) | | 10.3 |
| Pressure Ratio (Pmax/Pmin) | | 2.5 |

FULL CYCLE METRICS

Cold Sink Power Balance

| | | |
|---|---|---|
| \|Qout2\|-\|Qin1\| | 0.0 | kW |
| | 0.00 | MBTU/hr |
| | 0.00 | Ton |

Hot Sink Power Balance

| | | |
|---|---|---|
| \|Qout1\|-\|Qin2\| | 449.3 | kW |
| | 1.53 | MBTU/hr |
| | 127.74 | Ton |

Heat Exchanger Challenge

| | | |
|---|---|---|
| Cold Net Delta T | 2.0 | C |
| (T5-T3) | 3.6 | F |
| Hot Net Delta T | 2.0 | C |
| (T1-T7) | 3.6 | F |
| Storage Delta T | 33.0 | C |
| (T1-T3) | 59.4 | F |
| Generation Delta T | 29.0 | C |
| (T1-T3) | 52.2 | F |

Theoretical Efficiency 69%

|Wout|/(|Win1|+|Win2|)

COPCs/COPHg 70%

FIG. 3B

| | Station Description | Condenser Discharge | Expansion | Vaporizer | Compress |
|---|---|---|---|---|---|
| | Station # | 1 | 2 | 3 | 4 |
| Pressure | bara | 11.69 | 3.83 | 3.83 | 11.69 |
| | kPa | 1169 | 383 | 383 | 1169 |
| | psia | 169.5 | 55.5 | 55.5 | 169.5 |
| | psig | 155 | 41 | 41 | 155 |
| Temperature | C | 30.0 | -3.0 | 3.0 | 75.6 |
| | K | 303.2 | 270.1 | 270.2 | 348.7 |
| | F | 86.0 | 26.6 | 26.6 | 168.0 |
| | | | | | |
| Density | kg/m^3 | 595.170 | 24.509 | 3.101 | 7.383 |
| | kg/L | 0.5952 | 0.0245 | 0.0031 | 0.0074 |
| Enthalpy | kJ/kg | 484.3121 | 484.3121 | 1602.13 | 1758.73 |
| Entropy | kJ/(kgK) | 1.9596 | 1.9969 | 6.1327 | 6.1327 |
| IsobaricHeatCapacity | kJ/(kgK) | 4.8282 | Undefined | 2.6357 | 2.6081 |
| State | | Liquid | Sat Vap | Vapor | Vapor |
| Quality | %Vapor | 0.00% | 12.23% | 100.00% | 100.00% |
| | Fraction | 0.0000 | 0.1223 | 1.0000 | 1.0000 |
| | | | | | |
| Enthalpy Change (Delta-h) | kJ/kg | -1273.820 | 0.00 | 1117.21 | 156.60 |
| Theoretical Power | kW | -11696.4 | 0.0 | 10258.4 | 1438.0 |
| | HP | -15685 | 0 | 13757 | 1928 |
| | BTU/hr | -39945605 | 0 | 35034645 | 4910960 |
| | Therm/hr | -399.5 | 0.0 | 350.3 | 49.1 |
| | 1e6BTU/hr | -39.9 | 0.00 | 35.03 | 4.91 |
| | | | | | |
| Saturation temp., Tsat | K | 303.2 | 270.1 | 270.1 | 303.2 |
| | C | 30.05 | -3.02 | -3.02 | 30.05 |
| | F | 86.1 | 26.6 | 26.6 | 86.1 |
| Saturation pressure, Psat | bar | 11.7 | 3.8 | 3.8 | 11.7 |
| | kPa | 1169.0 | 383.0 | 383.0 | 1169.0 |
| Liquid Density | kg/L | 0.5951 | 0.6427 | 0.6427 | 0.5951 |
| Vapor Density | kg/L | 0.00907 | 0.00310 | 0.00310 | 0.00907 |
| Liquid Enthalpy | kJ/kg | 485.16 | 329.21 | 329.21 | 485.16 |
| Vapor Enthalpy | kJ/kg | 1629.35 | 1602.08 | 1602.08 | 1629.35 |
| Heat of vaporization | kJ/kg | 1144.2 | 1272.9 | 1272.9 | 1144.2 |
| Liquid Entropy | kJ/(kgK) | 1.9605 | 1.4205 | 1.4205 | 1.9605 |
| Vapor Entropy | kJ/(kgK) | 5.7342 | 6.1326 | 6.1326 | 5.7342 |

| Station Description | Condenser Discharge | Pump | Vaporizer | Expander |
|---|---|---|---|---|
| Station # | 5 | 7 | 7 | 8 |
| bara | 1.52 | 3.82 | 3.82 | 1.52 |
| kPa | 152 | 382 | 382 | 152 |
| psia | 22.04 | 55.39 | 55.39 | 22.04 |
| psig | 7 | 41 | 41 | 7 |
| C | 1.0 | -0.9 | 28.0 | 1.4 |
| K | 272.2 | 272.2 | 301.2 | 274.6 |
| F | 30.2 | 30.4 | 82.4 | 34.6 |
| | | | | |
| kg/m^3 | 581.722 | 581.967 | 9.909 | 4.088 |
| kg/L | 0.5817 | 0.5820 | 0.0099 | 0.0041 |
| kJ/kg | 197.72 | 198.11 | 591.92 | 556.91 |
| kJ/(kgK) | 0.9917 | 0.9917 | 2.3110 | 2.3110 |
| kJ/(kgK) | 2.2774 | 2.2763 | 1.8189 | 1.6212 |
| | Liquid | Liquid | Vapor | Vapor |
| %Vapor | 0.00% | 0.00% | 100.00% | 100.00% |
| Fraction | 0.0000 | 0.0000 | 1.0000 | 1.0000 |
| | | | | |
| kJ/kg | -359.193 | 0.40 | 393.81 | -35.01 |
| kW | -10258.4 | 11.3 | 11247.2 | -1000.0 |
| HP | -13757 | 15 | 15083 | -1341 |
| BTU/hr | -35034645 | 38556 | 38411289 | -3415200 |
| Therm/hr | -350.3 | 0.4 | 384.1 | -34.2 |
| 1e6BTU/hr | -35.0 | 0.04 | 38.41 | -3.42 |
| | | | | |
| K | 272.2 | 301.1 | 301.1 | 272.2 |
| C | -0.90 | 27.96 | 27.96 | -0.90 |
| F | 30.4 | 82.3 | 82.3 | 30.4 |
| bar | 1.5 | 3.8 | 3.8 | 1.5 |
| kPa | 152.0 | 382.0 | 382.0 | 152.0 |
| kg/L | 0.5816 | 0.5469 | 0.5469 | 0.5816 |
| kg/L | 0.00413 | 0.00991 | 0.00991 | 0.00413 |
| kJ/kg | 197.94 | 266.23 | 266.23 | 197.94 |
| kJ/kg | 553.13 | 591.86 | 591.86 | 553.13 |
| kJ/kg | 355.2 | 325.6 | 325.6 | 355.2 |
| kJ/(kgK) | 0.9925 | 1.2293 | 1.2293 | 0.9925 |
| kJ/(kgK) | 2.2971 | 2.3107 | 2.3107 | 2.2971 |

FIG. 3C

ENERGY STORAGE SYSTEMS

CROSS-REFERENCE TO RELATED APPLICATIONS

This application claims the benefit of U.S. Provisional Application 61/306,306, filed on Feb. 19, 2010, the entire contents of which is hereby incorporated herein by reference.

FIELD OF THE INVENTION

The present invention provides an energy storage device that utilizes a cold sink that undergoes cycles of phase change, e.g., freezing and thawing. The device converts electrical energy to stored thermal energy, and then re-converts the stored thermal energy to electrical energy, as needed or desired. The device can store energy on a large scale (e.g., on the order of megawatts or greater) and for an extended period of time (e.g., for at least 12 hours, or longer, as needed).

BACKGROUND OF THE INVENTION

Alternate energy systems such as solar photovoltaic (PV) and wind power face a challenge in that availability of energy supply is not synchronized with the demand for electricity. At present, there are a limited number of technologies available to store energy at the scale required for utility-level consumption (i.e. on the order of several megawatts). The current US electrical grid can tolerate approximately 10% alternate energy supply. The challenge in utility operations is to balance the available supply with demand. Given the present state of technology, short duration (minute time scale) load balancing is provided by fossil fuel fired power plants and, more particularly, by natural gas fired generators. To provide grid stability so that supply voltage to consumers is stable and to support a larger supply from alternate energy sources, a method must be developed for energy storage.

In the case of solar PV, the time duration for storage tends to be on the order of minutes. Solar PV output tends to peak during the day when the consumer demand tends to peak. Solar PV is subject to variable output due to clouds passing over the PV system.

In the case of wind power, there is an advantage in capital cost versus present solar PV technology. Wind power has a lower cost per unit power output than solar PV. Wind power suffers from two deficiencies. During an particular time period during the day, the wind generally experiences variance in strength on the order of seconds and minutes time scale. Furthermore, there is a diurnal variance in wind strength. In general winds tend to blow stronger at night than during the daytime. The availability of energy from the natural resource (i.e. the wind strength) is approximately twelve hours out of sync with ability of the grid to utilize this energy. Thus, there is a need for an energy storage means that transform the available energy from the wind at maximum efficiency, convert this energy into manageable form, and have a mechanism that can remove energy from this manageable form so that power output can respond to the second by second variance of consumer demand.

Due to normal climatic conditions, the wind tends to blow more strongly at night than during the day. Texas has an electric grid that is separate from the remainder of the US. In West Texas, the wind strength is suitable for driving wind turbines. Unfortunately, there is an excess of wind power generated at night. If the wind turbine operator generates power at night, they actually have to pay the utility. The utility is willing to buy power during the day; however, there is less wind power availability (due to lower wind speeds) during the daylight hours.

There is a need to decouple the potential to create power from the demand for the power, at least in time if not in location. This storage capacity need not extend over several days. It would be sufficient to store the generated power for approximately a 12 hour period. Also, in terms of efficiency, there is an advantage to optimizing the wind turbine controls to maximize the output of the turbine based on the current capacity of the wind, rather than limiting the turbines output based on the demand of the grid. This is why wind turbines are frequently seen not in operation. There may be wind available; however, there might be no instantaneous demand.

There are several different methods that have been piloted for energy storage:

Hydroelectric storage
Batteries
Compressed air
Flywheel
Hydrogen
Supercapacitors These techniques are summarized at the following web sites: sandia.gov/ess/About/newsevents.html#arpa-e and er.doe.gov/bes/reports/abstracts.html#EES.

In general, the renewable energy or alternate energy produced needs to be stored at its point of creation. To locate the source and the storage mechanism at different physical locations separated by wires would require either shared use of the electrical grid or the capital investment of a dedicated grid. In the former case, the transmission of power over the shared grid further contributes to grid instability.

In brief, hydroelectric storage uses available power at low demand periods to pump water into an elevated reservoir. During periods of peak demand, the power is released form the reservoir and passed through a hydroelectric turbine. The energy storage capacity of such a system is determined by the difference in elevation and the mass of water moved. These systems have a low energy storage density and are significantly constrained by the geology and topography at the installed location.

Suppose one wanted to store 22.5 MW-hr of power that would correspond to a 2.5 MW wind turbine operating at 75% capacity for 12 hours. Storing this much energy at a rise in height of 10 m (32.8 ft) requires a total area of 236,000 m2 (23.6 hectares, or 59 acres). Storage depth would be 3.5 m (11.5 ft). A significant quantity of land would be required in the near vicinity of each wind turbine. Also, one wind turbine does not generate that much energy. A typical, small fossil fuel power plant would be at least 150 MW, the equivalent of more than sixty 2.5 MW wind turbines.

The Tennessee Valley Authority (TVA) built a hydroelectric storage system in the 1960s at Raccoon Mountain. (Attached is a brochure and the information from Wikipedia.) The TVA converted an entire mountain into a storage facility comprised of a reservoir, pumping means to lift water into the reservoir, and a spillway and turbine system to create power. The geology and topography of this installation is unique and would not typically be found in locations where there is wind availability and, hence, ample wind energy for a wind farm. Furthermore, it is unclear if an organization could get such a civil engineering structure permitted today due to the alternation of the natural environment.

For batteries, the total energy storage needed is beyond most known technologies. There are significant limitations to battery electrolyte chemistry. This area is a focus for on-going US Department of Energy efforts on energy storage. Currently, the only technology that has been piloted for near utility scale are sodium-sulfur batteries. Sodium-sulfur batteries are efficient and, relatively, cheap. They do require the sodium to be molten. The battery electrolyte must be electrically heated to greater than 300° C. The batteries have an implicit safety hazard due to the combination of high temperatures and the reactivity of molten sodium. This technology requires utility scale inverters to convert DC (direct current) to AC (alternating current). There is only one commercial producer of these batteries in the world. (Advanced Sodium-Sulfur (NAS) battery systems by Tokyo Electric Electric Power Company, Japan).

Compressed air storage (CAS) is the third technique for energy storage. This system requires two critical components: large scale gas compressors that can be driven by an electric motor and one or more subterranean caverns. These systems can be built in areas where the local geology has produced underground caverns. The cavern must be sufficiently large to storage thousands of cubic meters of compressed air. The systems are limited to locations with this resource. Compressed air could be stored in pressure vessels; however, the storage density is low, thus many large and expensive pressure vessels would be required. Furthermore, there is an inherent inefficiency in this storage mechanism. The act of compressing air results in the creation of heat. This is irreversible work and is a permanent loss of the system.

Energy also can be stored in a flywheel. In this case, input power is used to increase the rotational speed of the flywheel. The speed and inertia of the flywheel determines the amount of energy stored. These systems have a significant challenge in that the flywheels require exotic composite materials. The systems are capital intensive to scale up to the MW-hr range required for utility level power storage.

Alternate energy could be used to electrolytically split water to create oxygen and hydrogen. The hydrogen could be separated and stored at elevated pressure. Unfortunately, this technique is not suitable for use with underground storage. Hydrogen creation has all the same disadvantages of CAS with the added disadvantage that expensive, above-ground high pressure vessels are required to store the gas. Moreover, because hydrogen is such a small molecule, the above ground storage tanks and associated piping and valves must be carefully engineered to limit the leak down rate.

Supercapacitors are similar to battery storage in that energy is stored as an electrical charge within the system. Under the present state of the art, supercapacitors are suitable for short term energy storage over a period measured in seconds. At present, state of the art units from Maxwell Technologies are more expensive than batteries when evaluated for their storage potential (A-hr). The devices are suitable for short term energy storage where the charge and discharge cycle is on the order of seconds and minutes. Supercapacitors have an advantage over batteries as they have a nearly infinite life and can be charged and discharged without capacity degradation.

There is an existing technology for peak shaving that uses ice as a storage means. The motivation behind this technology is to use off-peak power to storage energy and minimize the consumption of power during times of peak consumption. The medium for energy storage is ice. Commercial systems are available for sale, such as that marketed by Trane and Ice Energy. During the off-peak period (typically at night), electricity is used to drive a refrigerant compressor. The cold output of the refrigerant compressor is used to freeze water to form ice. During peak power demand (i.e. the dead of the day), a heat transfer medium is passed through the ice. The ice cools the heat transfer medium. The heat transfer medium is used, in turn, to cool building air. Thus this system is focused on avoidance of peak power consumption for powering an air conditioner. This system does not generate electrical power. It allows power to be consumed at off-peak times to offset a power load associated with cooling at a peak time period. This would work for an office or industrial building. This form of energy storage does not enable the energy that is stored in the ice to be recovered as electric current.

BRIEF SUMMARY OF THE INVENTION

The present methods and systems utilize a refrigerant circuit to consume electrical energy to generate heat and cold. The heat and/or cold are then used to store the energy. A second refrigerant circuit is used to delivery the energy, e.g., in desired amounts and to an appropriate location. The cold is stored in a phase change media ("PCM"), for example, water, salt, a saline solution, an ionic solution, inorganic materials, organic materials, and mixtures thereof. The hot can be stored in a "hot sink". Illustrative "hot sinks" include without limitation, natural aquifers, ground water and ambient air. The hot sink can also be a phase change material.

Accordingly, in one aspect, the present invention provides an energy storage device that converts electrical energy to stored thermal energy, and then converts the stored thermal energy to electrical energy, when needed or desired. An energy storage system comprising:

(a) a storage refrigerant circuit that receives input electric power and converts the electric power to stored thermal energy, the storage refrigerant circuit comprising:

(i) a compressor that receives input electric energy and pumps a first refrigerant through the circuit;

(ii) a first condenser in fluid communication with the compressor and in thermal communication with a hot sink;

(iii) a second condenser in fluid communication with the first condenser, wherein the second condenser releases heat sufficient to balance the energy around the hot sink;

(iv) an expansion valve in fluid communication with the second condenser; and (v) an evaporator in fluid communication with the expansion valve and the compressor, and in thermal communication with a cold sink, wherein the cold sink is maintained at a temperature that is less than about 0° C. and that is at least about 20° C. cooler than the hot sink, wherein heat transfer from the cold sink to the evaporator causes the cold sink to freeze, wherein thermal energy from the cold sink is delivered through the storage refrigerant circuit to the hot sink, thereby converting the input electric power to thermal energy stored in the hot sink; and (b) a generation refrigerant circuit that receives stored thermal energy from the hot sink and converts the stored energy to output electric power, the generation refrigerant circuit comprising:

(i) a pump that pumps a second refrigerant through the circuit;

(ii) a vaporizer in fluid communication with the pump and in thermal communication with the hot sink;

(iii) an expander in fluid communication with the vaporizer, wherein the expander produces output electric power; and (iv) a condenser in fluid communication with the expander and the pump, and in thermal communication with the cold sink, wherein thermal energy stored in the hot sink is delivered through the generation refrigerant circuit to the cold sink, driving the expander to produce output electric power, wherein heat transfer to the cold sink from the condenser causes the cold sink to melt, thereby converting the stored thermal energy to output electric power.

In a further aspect, the invention provides methods for storing energy by converting electrical energy to stored thermal energy and then re-converting the stored thermal energy to electrical energy, when needed or desired. Accordingly, the invention further provides methods of storing electrical energy, comprising:

(a) delivering electrical energy to a storage refrigerant circuit that receives input electric power and converts the electric power to stored thermal energy, the storage refrigerant circuit comprising:
(i) a compressor that receives input electric energy and pumps a first refrigerant through the circuit;
(ii) a first condenser in fluid communication with the compressor and in thermal communication with a hot sink;
(iii) a second condenser in fluid communication with the first condenser, wherein the second condenser releases heat sufficient to balance the energy around the hot sink;
(iv) an expansion valve in fluid communication with the second condenser; and
(v) an evaporator in fluid communication with the expansion valve and the compressor, and in thermal communication with a cold sink, wherein the cold sink is maintained at a temperature that is less than about 0° C. and that is at least about 20° C. cooler than the hot sink, wherein heat transfer from the cold sink to the evaporator causes the cold sink to freeze, wherein thermal energy from the cold sink is delivered through the storage refrigerant circuit to the hot sink, thereby converting the input electric power to thermal energy stored in the hot sink; and (b) delivering the stored thermal energy in the hot sink to a generation refrigerant circuit that receives stored thermal energy from the hot sink and converts the stored energy to output electric power, the generation refrigerant circuit comprising:
(i) a pump that pumps a second refrigerant through the circuit;
(ii) a vaporizer in fluid communication with the pump and in thermal communication with the hot sink;
(iii) an expander in fluid communication with the vaporizer, wherein the expander produces output electric power; and
(iv) a condenser in fluid communication with the expander and the pump, and in thermal communication with the cold sink, wherein thermal energy stored in the hot sink is delivered through the generation refrigerant circuit to the cold sink, driving the expander to produce output electric power, wherein heat transfer to the cold sink from the condenser causes the cold sink to melt, thereby converting the stored thermal energy to output electric power.

With respect to the embodiments of the systems and methods, in some embodiments, the energy storage system can store at least about 1 megawatt (MW) of thermal energy, for example, at least about 2 MW, 3 MW, 4 MW, 5 MW, 6 MW, 7 MW, 8 MW, 9 MW, 10 MW of thermal energy.

In some embodiments, the theoretical efficiency is at least about 50%, for example, at least about 55%, 60%, 65%, 70%, 75%, 80% or 85% efficient. In some embodiments, the practical efficiency is at least about 30%, for example, at least about 35%, 40%, 45%, 50%, 55% or 60% efficient.

In some embodiments, the storage refrigerant circuit and the generation refrigerant circuit run synchronously (i.e., run at the same time).

In some embodiments, the storage refrigerant circuit and the generation refrigerant circuit run asynchronously (i.e., do not run at the same time, or wherein the running of the generation refrigerant circuit is delayed from the running of the storage refrigerant circuit). In some embodiments, there is at least an 8 hour delay between the running of the storage refrigerant circuit and the running of the generation refrigerant circuit. In some embodiments, the delay between the running of the storage refrigerant circuit and the running of the generation refrigerant circuit is at least about 9, 10, 11, 12, 13, 14, 15, 16 hours, as needed or desired.

In some embodiments, the cold sink is at least about 30° C. cooler than the hot sink. In some embodiments, the cold sink is in the range of about 20-30° C. cooler than the hot sink, for example, about 20° C., 21° C., 22° C., 23° C., 24° C., 25° C., 26° C., 27° C., 28° C., 29° C., 30° C. cooler than the hot sink.

In some embodiments, the cold sink is maintained at about 0° C. and the hot sink is maintained at about 30° C. In some embodiments, the cold sink is maintained at a temperature in the range of about −5° C. to about 5° C., for example, about −5° C., −4° C., −3° C., −2° C., −1° C., 0° C., 1° C., 2° C., 3° C., 4° C. or 5° C. In some embodiments, the hot sink is maintained at a temperature of about 20° C. to about 30° C., for example, about 20° C., 21° C., 22° C., 23° C., 24° C., 25° C., 26° C., 27° C., 28° C., 29° C. or 30° C.

In some embodiments, the cold sink is a phase change material. In some embodiments, the cold sink is water. In some embodiments, the cold sink is a brine. In some embodiments, the brine is aqueous solution comprising a salt selected from sodium chloride, potassium chloride, sodium formate, potassium formate, or mixtures thereof. Concentration of the salt can be between about 0.1 wt % to about 15 wt %, for example, from about 1.0 wt % to about 10 wt %, or about 2.0 wt % to about 5.0 wt %. In some embodiments, the concentration of the salt is less than about 5 wt %, for example, in the range of about 0.1 wt % to about 5 wt %. In some embodiments, the concentration of salt is about 0.1 wt %, 0.2 wt %, 0.5 wt %, 0.8 wt %, 1.0 wt %, 1.5 wt %, 2.0 wt %, 2.5 wt %, 3.0 wt %, 3.5 wt %, 4.0 wt %, 4.5 wt %, 5.0 wt %, 6 wt %, 7 wt %, 8 wt %, 9 wt %, 10 wt %, 11 wt %, 12 wt %, 13 wt %, 14 wt %, 15 wt %.

In some embodiments, the hot sink is a phase change material. In some embodiments, the hot sink is water. In some embodiments, the hot sink is a natural aquifer or ground water. In some embodiments, the hot sink is water or a phase change solid, for example, animal fat or white grease. In addition, water drawn from a well or surface water finds use to reject excess heat.

In various embodiments, the cold sink is a phase change material and the hot sink is a phase change material.

In some embodiments, the first refrigerant is ammonia. In some embodiments, the first refrigerant is R134a (1,1,1,2-tetrafluoroethane, CAS No. 811-97-2) or R410a (mixture of 50 wt % R32 (difluoromethane) and 50 wt % R125 (pentafluoroethane)).

In some embodiments, the second refrigerant is a lower alkyl hydrocarbon. In some embodiments, the second refrigerant is selected from the group consisting of isobutane, propane, butane and dimethyl ether. In some embodiments, the second refrigerant is isobutane. In some embodiments, the second refrigerant is R134a.

In some embodiments, the first refrigerant is ammonia and the second refrigerant is isobutane.

In some embodiments, the first refrigerant is pumped through the storage refrigerant circuit at flow rate between about 30,000 kg/hr to about 40,000 kg/hr.

In some embodiments, the second refrigerant is pumped through the generation refrigerant circuit at a flow rate between about 100,000 kg/hr to about 125,000 kg/hr.

In some embodiments, the second condenser in the storage refrigerant circuit releases excess heat into the air. In some embodiments, the second condenser in the storage refrigerant circuit releases excess heat into water. In some embodiments, the second condenser in the storage refrigerant circuit releases excess heat into the hot sink.

In some embodiments, the storage refrigerant circuit is in communication with a motor powered by an electricity generating source. The electricity generating source can be a renewable energy source, for example, a turbine powered by wind, wave or hydroelectrical power, or a solar energy-powered photovoltaic unit. In some embodiments, the electricity generating source is one or more solar energy-powered photovoltaic units. In some embodiments, the electricity generating source is one or more wind turbines.

In some embodiments, the expander in the generation refrigerant circuit is in communication with a generator that is in communication with an electrical grid.

DEFINITIONS

The term "lower alkyl hydrocarbon" refers to a chemical compound with 6 or fewer carbon atoms, for example, 1, 2, 3, 4, 5 or 6 carbon atoms. The compound many also have one or more heteroatoms (e.g., O, N, S). The hydrocarbon can be branched or unbranched, and be saturated or unsaturated. The lower alkyl hydrocarbons for use in the present energy storage system operate as refrigerants. Lower alkyl hydrocarbons that naturally occur in the gas phase at ambient temperatures and pressures are of particular interest.

The term "phase change material" refers to a material useful to store the latent heat absorbed in the material during a phase transition.

DETAILED DESCRIPTION

1. Introduction

The present invention leverages the phase change in a phase change material to store thermal energy. Power from an alternate energy source is used to drive a refrigerant circuit to produce phase change in a cold sink and/or a hot sink. In various embodiments, the present energy storage systems utilize a hot source and a cold source that both employ phase change materials (PCM). The PCM assures that the hot and cold sources remain at constant temperature. Thus, the temperature difference for the storage circuit and generation circuit is constant. With the storage circuit, the input of electric power creates both cold and heat. The present energy storage systems utilize the storage energy in both the cold PCM and hot PCM. In certain embodiments, water or water in admixture with one or more salts finds use as a cold PCM. The generation circuits in the present energy storage systems offer increased efficiency because the hot and cold source is held at a nearly constant and predictable temperature difference. This enables the optimal selection of both working fluid and systems pressures to match the hot and cold PCM melting points.

In other energy storage methods, the generation circuit rejects its heat into the ambient environment. This could be in the form of a working fluid to air exchanger (fan cooler) or a working fluid to water exchanger. The water could be evaporative in a particularly low dew point environment or it could be subsurface water that is at a cold temperature and, in turn, the heat is rejected into the earth. The use of a PCM in cold sink eliminates the need for any of these systems.

In various embodiments, a PCM, e.g., ice, is used in a heat engine to drive a compressor backwards (i.e., to drive an expander) to produce electrical power. The energy storage systems of the invention utilize a dual turbomachine system with a storage refrigerant circuit and a generation refrigerant circuit (see, FIGS. 1 and 2). The storage refrigerant circuit is depicted on the left-hand side; the generation refrigerant circuit is depicted on the right-hand side. The storage refrigerant circuit can operate asynchronously from the generation refrigerant circuit.

Figure 1:
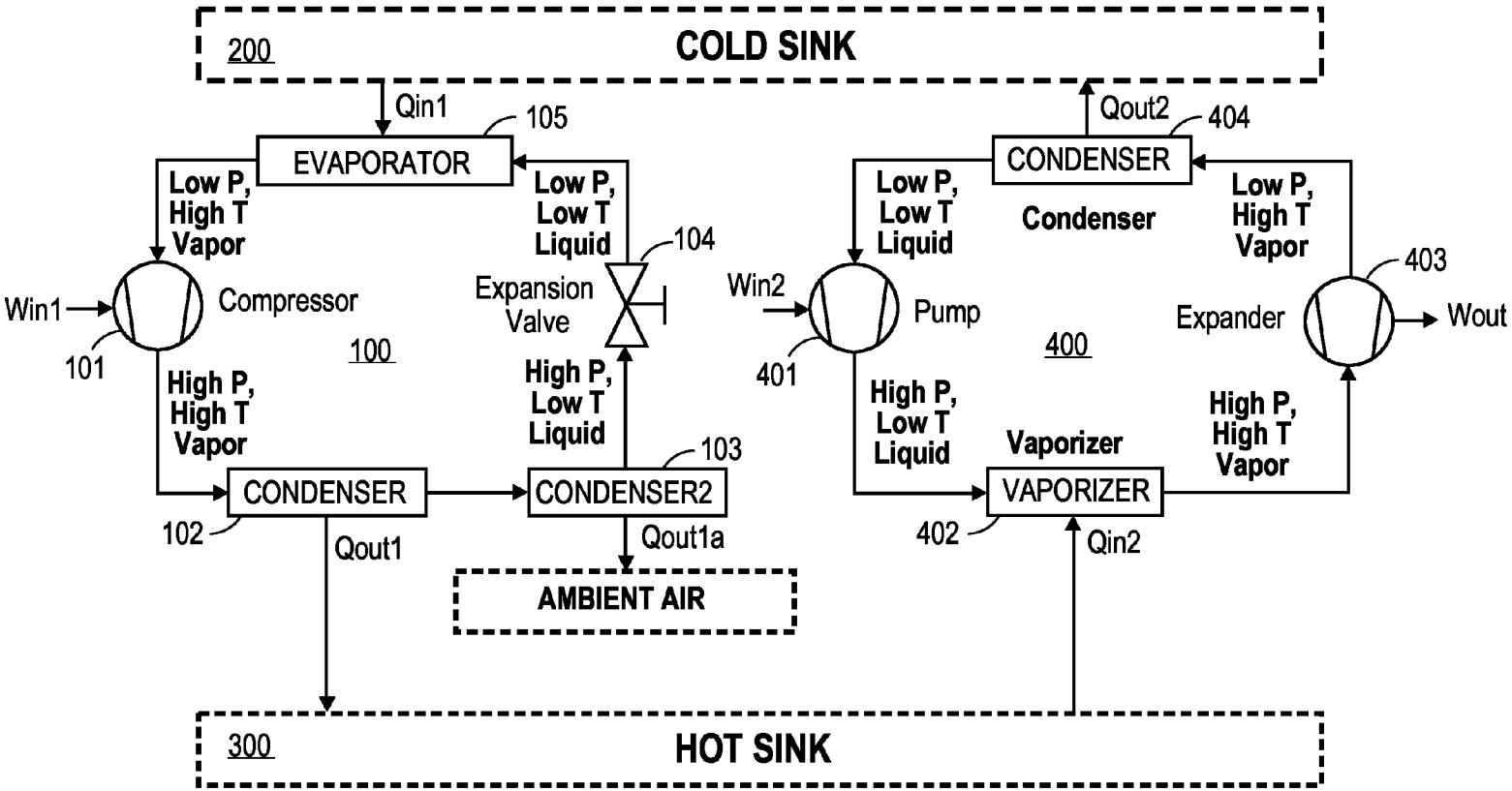
FIG. 1 shows an embodiment of the energy storage system wherein the second condenser releases excess heat into ambient air.

The expander of the generation refrigerant circuit generates electrical power as shown as Wout in FIG. 1. Ice created by a conventional means provides the source of cooling for the condenser in the generation refrigerant circuit. The energy from the ice is extracted to transform the working fluid in the generation refrigerant circuit from a low pressure/high temperature state to a low pressure/low temperature state. For example, the refrigerant fluid in the generation refrigerant circuit can be transformed from a vapor to a liquid. A pump elevates the refrigerant fluids pressure. Thermal energy from a hot sink elevates the temperature of the refrigerant fluid in the generation refrigerant circuit to causes it to change phase from a liquid to a vapor. The heat input for the vaporizer may come from a variety of sources, including waste industrial heat, ambient air temperature, surface water, subterranean/aquifer water, or geothermal heat.

Win1 represents the work (electrical power input) to propel the working fluid around the storage refrigerant circuit. This power input is larger than the power output as defined by Wout.

This system is more efficient than the CAS system because the compressor to create ice and the pump in FIG. 1 are more efficient than a compressor used to compress air. There is less energy lost in the compression and coupled heating of the working fluid.

The energy storage system can be optimized to generate peak power depending on the availability of the alternate or renewable energy source. Because there is a storage means for energy, the energy storage system can be optimized to maximize its power output as desired and on an as-needed basis, depending on the availability of the alternate energy source. Thus, in the case of a wind turbine, a greater fraction of the turbine's capacity can be used. To the extent that there is available alternate or renewable energy supply, this energy would be used to create ice and store thermal energy.

The output of the alternate or renewable energy source can be used to power the system to freeze ice. The largest consumption of electricity would be the refrigerant compressor in the storage refrigerant circuit. The refrigerant compressor could use any common refrigerant. The refrigerant would be expanded to create ice.

A significant quantity of ice is required to store energy for a 12 hour period. In the case of 1.0 MW for 12 hours, this would require approximately 370,000 gallons of storage. This is the equivalent of a 52 foot diameter×32 foot tall oil storage tank (a small tank at an oil refinery). Relatively standard liquid storage tanks are available to sizes up to 2,000,000 gallons (104 ft diam.×32 ft. tall). Other standard "oil" tanks include:

| | |
|---|---|
| 52' × 32' | 500,000 gal |
| 63' × 32' | 750,000 gal |
| 73' × 32' | 1,000,000 gal |
| 90' × 32' | 1,500,000 gal |
| 104' × 32' | 2,000,000 gal |

Thus, the invention can leverage conventional technology for the creation of ice from electrical energy. The system, as proposed, could help further increase the efficiency of renewable energy power generation since the power output would not need to be filtered and smoothed as required to meet grid power quality standards. The renewable energy power could be consumed at the point of the renewable energy source with a refrigerant compressor system that was tolerant of low quality wind power. The produced power, since it is extracted from a thermal source, would readily meet grid power quality standards.

Furthermore, there is an advantage if a renewable energy source (e.g., solar or wind) is used in an off-grid location, for example, at locations for remote mineral and oil exploration, remote village power (e.g., in northern Alaska or Canada), alternate energy for deployment in disaster situations in which grid power has been destroyed, and remote military operations. In the military case, the cost and risk of fuel (e.g., diesel or JP8) hauling for electrical power can justify the installation of a renewable energy source with energy storage.

The systems can be configured appropriate to their geographical location of use. For example, for systems implemented in a nominally ambient temperature area, e.g., such as that characteristic of San Joaquin central valley of California, materials for both cold storage and hot storage would be employed. In a warm climate, e.g., such as Death Valley, Calif. or Qatar or Saudi Arabia, heat could be obtained from the ambient environment and a material for cold storage would be employed. In a far northern or southern climate, e.g., such as Northern Alaska or Northern Canada or Antarctica, cold could be obtained from the ambient environment and a material or source for hot storage would be employed. Moreover, the configuration of the energy storage system may change depending on the regional climatic conditions and, in the case of a portable system, the seasonal variations in ambient temperature. Thus, the configuration could be different in Alaska in winter versus summer and in Qatar in the summer months versus the winter.

The present energy storage systems store energy so that demand needs throughout the day can be balanced with available energy in the natural resource. Absent a storage mechanism, there has to be one-to-one correspondence between generation and consumption. The present energy storage systems allow use of renewable energy sources with intermittent energy production without requiring a non-renewable power source to balance or smooth output, e.g., into an electrical grid.

2. Energy Storage System

Figure 2:
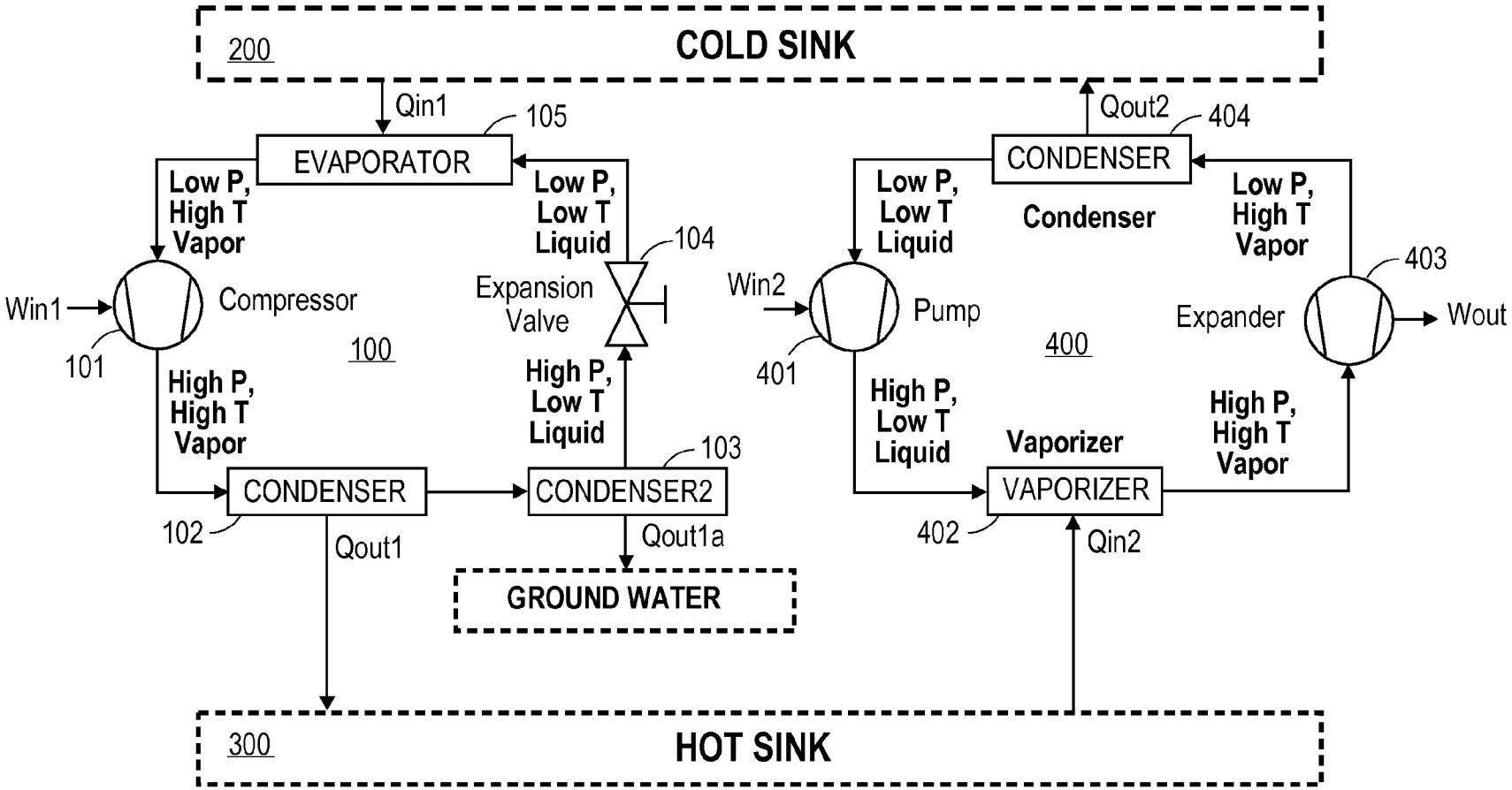
FIG. 2 shows an embodiment of the energy storage system wherein the second condenser releases excess heat into water.

The energy storage system of the invention is generally comprised of a (1) storage refrigerant circuit (100), (2) a cold sink (200), (3) a hot sink (300), and (4) a generation refrigerant circuit (400). These elements are depicted in FIGS. 1 and 2.

The energy storage system is generally located at the point of creation of the energy. The energy storage system is located close enough to the energy production source (e.g., the wind turbine(s) or photo voltaic unit(s)) such that the energy production source and energy storage system are not separated by wires that would require an electrical grid, e.g., shared use of an electrical grid or capital investment of a dedicated grid. In some embodiments, the energy storage system is located at a distance of less than about 1 km from the point of generation, for example, less than about 0.75 km, 0.50 km, 0.25 km or 0.1 km from the point of generation. In some embodiments, for remote storage to counteract the limits of the power transmission network at peak load times, the present energy storage systems could be located hundreds of kilometers from the power generation location.

a. Storage Refrigerant Circuit

The storage refrigerant circuit (100) includes five elements: (1) a compressor (101), (2) a first condenser (102) in thermal communication with the hot sink (300), (3) a second condenser (103) to release heat sufficient to balance energy around the hot sink (300), (4) an expansion means (104) (e.g. an orifice plate, a line restriction, or a valve), and (5) an evaporator (105) in thermal communication with the cold sink (200). The present systems can use commercially available compressors, for example compressors produced by Frick; Solar Turbines; Elliot; Burckhardt; Ingersold Rand; AG Kuhnle, Kopp & Kausch; York; and Corken can find use. Heat exchangers that can find use are available, e.g., from Alfa Laval, Trantor, APV, Armstrong and GEA Heat Exchangers.

The storage refrigerant circuit converts input electrical energy into thermal energy that is stored in the hot sink. Heat is pulled out of the first refrigerant by the first condenser and rejected into the heat sink. The first condenser converts the vaporized first refrigerant to a liquid prior to flow through the expansion means. The cold refrigerant absorbs heat from the cold sink to vaporize the refrigerant, and cause the cold sink to freeze. The compressor converts refrigerant vapor from a low pressure condition to a high pressure condition.

Electrical energy, for example, from a renewable energy source, is delivered to the compressor of the storage refrigerant circuit (Win1). The renewable energy source can be, e.g., solar, wind, wave or geothermal energy. Energy delivered to the compressor of the storage refrigerant circuit drives the compressor to pump the first refrigerant through the circuit. The energy is used to drive the transfer of heat from the cold sink to the hot sink, where it is stored as thermal energy.

Preferably the first refrigerant is R717 (ammonia=NH3). In other embodiments, the first refrigerant is R134a (1,1,1,2-tetrafluoroethane, CAS No. 811-97-2) or R410a (mixture of 50 wt % R32 (difluoromethane; CAS No. 75-10-5) and 50 wt % R125 (pentafluoroethane; CAS No. 354-33-6)). Other refrigerants that find use in the storage refrigerant circuit include without limitation R12, R113, R114, R115, R-502 (Mix of 48.8 wt % R-22/51.2 wt % R-115), R22, R123, R124, R141b, R142b, R225ca, R225cb, R23, R32, R125, R134a, R143a, R152a, R227ea, R236fa, R245ca, R410a (R32/125 (50/50 wt %)), R407c (R32/125/134a (23/25/52 wt %)), R404a (R125/134a/143a (44/4/52 wt %)), R507a (R125/143a (50/50 wt %)), R14 ($CF_4$), R116 (C2F6), R218 (C3F8), R318 (c-C4F8), sulfur hexafluoride (SF6), R290 (propane), R600a (isobutane), and isobutene.

The mass flow rate of the first refrigerant through the energy storage circuit depends on the selected refrigerant. For example, if ammonia is used as the first refrigerant, the mass flow rate can be under 40,000 kg/hr, for example, in the range of about 30,000-40,000 kg/hr, for example, about 30,000 kg/hr, 31,000 kg/hr, 32,000 kg/hr, 33,000 kg/hr, 34,000 kg/hr, 35,000 kg/hr, 36,000 kg/hr, 37,000 kg/hr, 38,000 kg/hr, 39,000 kg/hr or 40,000 kg/hr. If refrigerant R134a is used as the first refrigerant, the mass flow rate is in the range of about 235,000 kg/hr to about 270,000 kg/hr, for example, about 235,000 kg/hr, 240,000 kg/hr, 245,000 kg/hr, 250,000 kg/hr, 255,000 kg/hr, 260,000 kg/hr, 265,000 kg/hr or 270,000 kg/hr.

With respect to the size of the storage refrigerant circuit, the pipes or conduits through which the first refrigerant is pumped can be in the range of about 1 to about 12 inches in diameter, for example and average of about 1, 2, 3, 4, 5, 6, 7, 8, 9, 10, 11 or 12 inches in diameter, as needed or desired. The diameter of conduit used will depend on the mass flow rate of refrigerant. Conduits of smaller diameter can be used with refrigerants requiring a smaller mass flow rate. The conduits connecting the different components of the storage refrigerant circuit can have the same or different diameters, as appropriate.

The pipes or conduits through which the first refrigerant is pumped can have a length in the range of about 5 to about 500 feet long, for example, in the range of about 5 to about 100 feet long, for example, on the order of about 5, 10, 15, 20, 25, 30, 35, 40, 45, 50, 55, 60, 65, 70, 75, 80, 85, 90, 95 or 100 feet long, as needed or desired. The length of conduit used will depend on the mass flow rate of refrigerant. Conduits of shorter length can be used with refrigerants requiring a smaller mass flow rate. The conduits connecting the different components of the storage refrigerant circuit can have the same or different lengths, as appropriate.

Energy balance around the storage refrigerant circuit can be expressed by the following equations:

$$W\text{in}1+Q\text{in}1=Q\text{out}1+Q\text{out}1a;\ \text{or}$$

$$Q\text{out}1a=W\text{in}1+Q\text{in}1-Q\text{out}1$$

Qout1*a* through the second condenser in the storage refrigerant circuit disposes of the excess heat created in this circuit. Heat release through the second condenser is an opportunity for energy "cogeneration." It is possible to generate heat, e.g., for heating or industrial processing, while storing energy to make electricity, on demand, at a different point in time. In some embodiments, the heat release from the storage refrigerant loop is used to heat the hot sink.

b. Cold Sink

The cold sink is preferably a phase change material ("PCM"), i.e., a material that can undergo a phase change to effect storage of energy. Phase change materials are known in the art and find use. Illustrative phase change materials include without limitation water, ionic solutions, inorganic materials and mixtures, and organic materials and mixtures that experience a phase change. Compatible phase change materials are commercially available, e.g., from Phase Change Material Products Limited (on the internet at pcm-products.net). PCM of use in the cold sink generally have a latent heat of fusion in the range of about 50 kJ/kg to about 500 kJ/kg, for example, about 50 kJ/kg, 100 kJ/kg, 150 kJ/kg, 200 kJ/kg, 250 kJ/kg, 300 kJ/kg, 350 kJ/kg, 400 kJ/kg, 450 kJ/kg or 500 kJ/kg. Higher values are preferred. For comparison, water has a latent heat of fusion of about 333 kJ/kg.

Density of the PCM is not critical in terms of its weight; however, it impacts the spatial efficiency and, thus, the cost of the cold sink. It is desirable for the latent heat of the cold PCM to be in the range of about 50 to about 500 MJ/m$^3$, for example, from about 100 MJ/m$^3$ to about 300 MJ/m$^3$, for example, from about 150 MJ/m$^3$ to about 275 MJ/m$^3$, for example, about 50 MJ/m$^3$, 100 MJ/m$^3$, 150 MJ/m$^3$, 200 MJ/m$^3$, 250 MJ/m$^3$, 300 MJ/m$^3$, 350 MJ/m$^3$, 400 MJ/m$^3$, 450 MJ/m$^3$ or 500 MJ/m$^3$. The product of the latent heat on a mass basis (i.e. MJ/kg=energy/unit mass) and the density (i.e. kg/m$^3$=mass/unit volume) produces the latent heat of fusion of the PCM on a volumetric basis (energy/unit volume). Illustrative PCM from Phase Change Material Products Limited that find use in the present invention include without limitation, e.g., A2, A3, A4, A6, A8, A9, A15, A17, S7, S8, S10, S13, S15, S17 and S19. Preferably, the phase change temperature of the cold sink is at least about 20° C. cooler, e.g., at least about 25° C., 30° C., 35° C. or 40° C. cooler, than the phase change temperature of the hot sink.

In various embodiments, the cold sink (200) can be water, or a water solution with a salt (i.e., a brine) to depress the freezing point. Salts that find use include sodium salts and potassium salts. For example, the brine can be an aqueous solution comprising a salt selected from sodium chloride, potassium chloride, sodium formate, potassium formate, or mixtures thereof. Concentration of the salt can be between about 0.1 wt % to about 15 wt %, for example, from about 1.0 wt % to about 10 wt %, or about 2.0 wt % to about 5.0 wt %. In some embodiments, the concentration of the salt is less than about 5 wt %, for example, in the range of about 0.1 wt % to about 5 wt %. In some embodiments, the concentration of salt is about 0.1 wt %, 0.2 wt %, 0.5 wt %, 0.8 wt %, 1.0 wt %, 1.5 wt %, 2.0 wt %, 2.5 wt %, 3.0 wt %, 3.5 wt %, 4.0 wt %, 4.5 wt %, 5.0 wt %, 6 wt %, 7 wt %, 8 wt %, 9 wt %, 10 wt %, 11 wt %, 12 wt %, 13 wt %, 14 wt %, 15 wt %.

The cold sink is maintained at a temperature that is around its freezing point, for example, in the range of about −10° C. to 10° C. below and above the freezing point, or in the range of −5° C. to 5° C., −4° C. to 4° C., −3° C. to 3° C., −2° C. to 2° C., or −1° C. to 1° C. below and above the freezing point. The targeted freezing point of the cold sink will depend on the ambient temperature around the energy storage system, as well as the first and second refrigerants used. In some embodiments, the cold sink is maintained at a temperature that is at or below about 0° C., for example, in the range of about −40° C. to 0° C., −20° C. to 0° C., −10° C. to 0° C., −5° C. to 0° C., for example, at a temperature of about −40° C., −35° C., −30° C., −25° C., −20° C., −15° C., −10° C., −5° C., −4° C., −3° C., −2° C., −1° C. or 0° C.

The size of the cold sink depends on the amount of energy to be stored. The volume of the cold sink is of a size sufficient to store the desired amount of thermal energy. One megawatt of power can be stored for 12 hours in about 370,000 gallons of frozen water or brine solution. Depending on the amount of energy to be stored, the cold sink can have a total volume in the range of 50,000 to about 2,000,000 gallons, for example, in the range of about 100,000 to about 1,000,000 gallons, or about 100,000 to about 500,000 gallons. In some embodiments, the cold sink has a volume of about 50,000 gallons, 100,000 gallons, 200,000 gallons, 250,000 gallons, 300,000 gallons, 350,000 gallons, 400,000 gallons, 500,000 gallons, 750,000 gallons, 1,000,000 gallons, 1,500,000 gallons or 2,000,000 gallons. The cold sink can be contained in one or more containers. In some embodiments, the cold sink is in one container. In some embodiments, the cold sink is in 2, 3, 4, 5, or more, containers.

In some embodiments, the cold sink is of a size or volume sufficient to store at least about 0.5 megawatts (MW) of thermal energy. In some embodiments, the cold sink is of a size or volume sufficient to store at least about 1 MW of thermal energy, for example, at least about 1.5 MW, 2.0 MW, 2.5 MW, 3.0 MW, 3.5 MW, 4.0 MW, 4.5 MW, 5.0 MW, 6.0 MW, 7.0 MW, 8.0 MW, 9.0 MW or 10 MW of thermal energy.

c. Hot Sink

In various embodiments, the hot sink can be a PCM. Illustrative phase change materials include without limitation water, ionic solutions, inorganic materials and mixtures, and organic materials and mixtures that experience a phase change. Compatible phase change materials are commercially available, e.g., from Phase Change Material Products Limited (on the internet at pcmproducts.net). Similar to the design of the cold sink, PCM of use in the hot sink generally have a latent heat of fusion in the range of about 50 kJ/kg to about 500 kJ/kg, for example, about 50 kJ/kg, 100 kJ/kg, 150 kJ/kg, 200 kJ/kg, 250 kJ/kg, 300 kJ/kg, 350 kJ/kg, 400 kJ/kg, 450 kJ/kg or 500 kJ/kg. Again, higher values are preferred.

Similar to the design of the cold sink, density of the PCM is not critical in terms of its weight; however, it impacts the spatial efficiency and, thus, the cost of the hot sink. It is desirable for the latent heat of the cold PCM to be in the range of about 50 to about 500 $MJ/m^3$, for example, from about 100 $MJ/m^3$ to about 300 $MJ/m^3$, for example, from about 150 $MJ/m^3$ to about 275 $MJ/m^3$, for example, about 50 $MJ/m^3$, 100 $MJ/m^3$, 150 $MJ/m^3$, 200 $MJ/m^3$, 250 $MJ/m^3$, 300 $MJ/m^3$, 350 $MJ/m^3$, 400 $MJ/m^3$, 450 $MJ/m^3$ or 500 $MJ/m^3$. Illustrative PCM from Phase Change Material Products Limited that find use in the present invention include without limitation, e.g., A17, A22, A23, A24, A25, A28, A32, A39, A42, A53, A55, A58, A60, A62, A70, S17, S19, S32, S34, S44, S46, S50, S58, S72 and S83. Preferably, the phase change temperature of the host sink is at least about 20° C. warmer, e.g., at least about 25° C., 30° C., 35° C. or 40° C. warmer, than the phase change temperature of the cold sink.

In various embodiments, the hot sink (300) or hot source can be water or ambient air. The hot sink can be from a naturally-occurring or man-made source. For example, the hot sink can be an aquifer or ground water, surface water, hot water from a geothermal source, hot water from a distributed solar collector. In other embodiments, the hot sink is an insulated water tank. The hot sink can be heated using the excess heat output produced by the storage refrigerant circuit.

The hot sink is maintained at a temperature that is at least about 20° C. warmer than the temperature of the cold sink, for example, in the range of about 20° C. to about 40° C. warmer than the cold sink or about 20° C. to about 30° C. or 35° C. warmer than the cold sink. The targeted temperature of the hot sink will depend on the ambient temperature around the energy storage system, as well as the first and second refrigerants used. In some embodiments, the hot sink is maintained at a temperature that is at or above about 10° C., for example, in the range of about 10° C. to about 40° C., for example, about 15° C. to about 35° C. or about 20° C. to about 30° C. In some embodiments, the hot sink is maintained at a temperature of about 10° C., 15° C., 20° C., 25° C., 30° C., 35° C. or 40° C.

The size of the hot sink depends on the amount of energy to be stored. The volume of the hot sink is of a size sufficient to store the desired amount of thermal energy. Depending on the amount of energy to be stored, the hot sink can have a total volume in the range of 50,000 to about 2,000,000 gallons, for example, in the range of about 100,000 to about 1,000,000 gallons, or about 100,000 to about 500,000 gallons. In some embodiments, the hot sink has a volume of about 50,000 gallons, 100,000 gallons, 200,000 gallons, 250,000 gallons, 300,000 gallons, 350,000 gallons, 400,000 gallons, 500,000 gallons, 750,000 gallons, 1,000,000 gallons, 1,500,000 gallons or 2,000,000 gallons. The hot sink can be contained in one or more containers. In some embodiments, the hot sink is in one container. In some embodiments, the hot sink is in 2, 3, 4, 5, or more, containers.

In some embodiments, the hot sink is of a size or volume sufficient to store at least about 0.5 megawatts (MW) of thermal energy. In some embodiments, the hot sink is of a size or volume sufficient to store at least about 1 MW of thermal energy, for example, at least about 1.5 MW, 2.0 MW, 2.5 MW, 3.0 MW, 3.5 MW, 4.0 MW, 4.5 MW, 5.0 MW, 6.0 MW, 7.0 MW, 8.0 MW, 9.0 MW or 10 MW of thermal energy.

In various embodiments with respect to the hot sink, it is possible to couple the cold storage with a diesel engine driven generator set or an industrial gas turbine generator set. In the cases using a diesel engine driven generator set, devices commercially available from, e.g., Caterpillar Diesel Generators (Genset) (cat.com) and Cummins Onan (cumminsonan.com/cm/) find use. Caterpillar Diesel Gensets ranging in size from 12 kW to 17460 kW are compatible, among others. Alternatively, the diesel engine driven generator set can be powered by landfill methane, agricultural bio-gas, or natural gas. In the case of diesel or these other fuels, the genset can be powered by a piston-driven engine. For an industrial gas turbine, devised commercially available from, e.g., Solar Turbines (mysolar.cat.com/), Rolls-Royce (rolls-royce.com/energy/), GE Energy (gepower.com/prod_serv/products/gas_turbines_cc/en/index.htm), or Siemens (energy.siemens.com/hq/en/power-generation/gas-turbines/) find use.

In various embodiments, the hot sink can be heat output from a solar concentrator. This could involve both a stationary concentrator (i.e., one in which the parabolic mirror does not track the sun's motion) and tracking concentrators (i.e., a moving dish that tracks the movement of the sun). The stationary concentrator could be a parabolic trough solar concentrator (en.wikipedia.org/wiki/Parabolic trough), e.g., as embodied in the system installed at Kramer Junction, Calif. (ludb.clui.org/ex/i/CA9679/). Tracking concentrators are commercially available, e.g., from Southwest Solar Technologies (swsolartech.com/).

d. Generation Refrigerant Circuit

The generation refrigerant circuit (400) includes four elements: (1) a pump (401), (2) a vaporizer (402) in thermal communication with the hot sink (300), (3) an expander (403), and (4) a condenser (403) in thermal communication with the cold sink (200). The present systems can use commercially available pumps, for example, pumps produced by Blackmer; Corken; Tuthill, and Elmo Rietschle find use. Heat exchangers that can find use are available, e.g., from Alfa Laval, Trantor, APV, Armstrong and GEA Heat Exchangers.

The generation refrigerant circuit converts stored thermal energy in the hot sink into output electrical energy. Heat is pulled out of the hot sink by the vaporizer into the second refrigerant and rejected into the cold sink. The vaporizer converts the liquid phase second refrigerant to a vapor prior to flow through the expander. The heated refrigerant rejects heat into the cold sink, returning the refrigerant to liquid phase, and causing the cold sink to melt. The pump converts refrigerant vapor from a low pressure condition to a high pressure condition.

Figure 4:
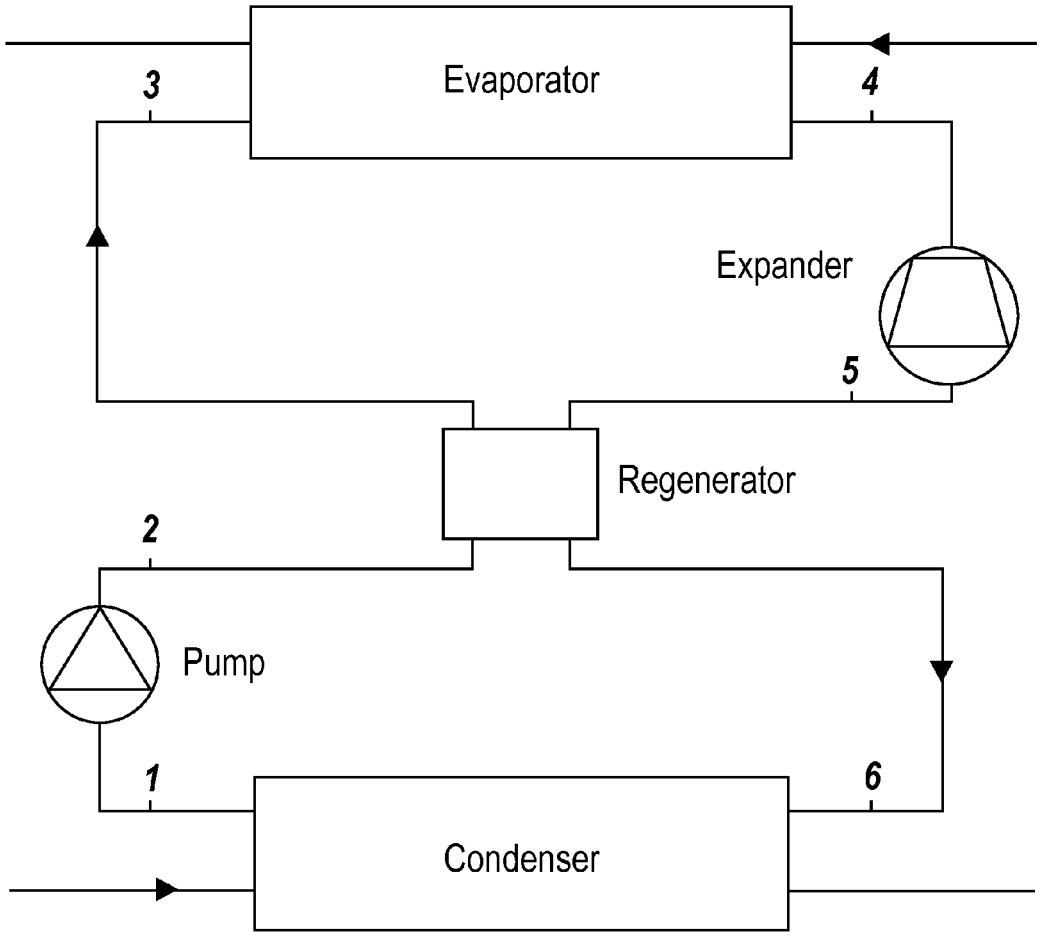
FIG. 4 shows an embodiment of the energy storage system comprising a regenerator.

Energy delivered to the pump of the generation refrigerant circuit drives the pump to pump the second refrigerant through the circuit. The energy is used to drive the transfer of heat from the hot sink to the cold sink, thereby powering the expander to expend electrical energy (Wout). In various embodiments, the generation refrigerant circuit can employ any of a number of alkane gases as the refrigerant in the generation system. For example, technologies applied in geothermal electrical power generation find use in the present systems. See, e.g., the internet at en.wikipedia.org/wiki/Geothermal_electricity or rasertech.com/geothermal/geothermal-multimedia/geothermal-process-animation-video. In geothermal electrical power generation systems, the hot source is a deep well that draws hot water or hot saline solution from deep underground. This provides the hot input into an organic rankine cycle (ORC) (on the internet at en.wikipedia.org/wiki/Organic_Rankine_Cycle). Heat is extracted from the ground. Heat is rejected into the environment via either fan coolers or water cooling towers. The latter leverage the heat of vaporization of water and the dewpoint of the ambient environment to achieve cooling. Geothermal systems and components are produced by Ormat Technologies (ormat.com), and Pratt and Whitney PureCycle® (pw.utc.com). An ORC generally utilizes a turboexpander, also shown FIGS. 1 and 2 as an "Expander." Turboexpanders compatible with the present systems are available from numerous manufacturers, including without limitation, Infinity Turbine (infinityturbine.com), Atlas Copco (atlascopcogap.com), GE Rotoflow (ge-energy.com), MAN, Siemens, and Elliott. As with improvements in the ORC, the present refrigerant circuit can be enhanced through the use of a regenerator. Regenerators are heat exchangers available from numerous manufacturers, e.g., including Alfa Laval, Trantor, APV, Armstrong and GEA Heat Exchangers. See, FIG. 4. The expander can be in communication with a generator, which can be in communication with an electrical grid.

The mass flow rate of the second refrigerant through the energy storage circuit depends on the selected refrigerant. For example, if isobutane is used as the second refrigerant, the mass flow rate can be under 125,000 kg/hr, for example, in the range of about 90,000-125,000 kg/hr, for example, about 90,000 kg/hr, 92,000 kg/hr, 95,000 kg/hr, 98,000 kg/hr, 100,000 kg/hr, 102,000 kg/hr, 105,000 kg/hr, 108,000 kg/hr, 110,000 kg/hr, 115,000 kg/hr, 120,000 kg/hr or 125,000 kg/hr. If refrigerant R134a (1,1,1,2-tetrafluoroethane, CAS No. 811-97-2) is used as the second refrigerant, the mass flow rate is in the range of about 190,000 kg/hr to about 210,000 kg/hr, for example, about 190,000 kg/hr, 195,000 kg/hr, 200,000 kg/hr, 215,000 kg/hr, 210,000 kg/hr.

With respect to the size of the generation refrigerant circuit, the pipes or conduits through which the second refrigerant is pumped can be in the range of about 1 to about 12 inches in diameter, for example and average of about 1, 2, 3, 4, 5, 6, 7, 8, 9, 10, 11 or 12 inches in diameter, as needed or desired. The diameter of conduit used will depend on the mass flow rate of refrigerant. Conduits of smaller diameter can be used with refrigerants requiring a smaller mass flow rate. The conduits connecting the different components of the generation refrigerant circuit can have the same or different diameters, as appropriate.

The pipes or conduits through which the second refrigerant is pumped can have a length in the range of about 5 to about 500 feet long, for example, in the range of about 5 to about 100 feet long, for example, on the order of about 5, 10, 15, 20, 25, 30, 35, 40, 45, 50, 55, 60, 65, 70, 75, 80, 85, 90, 95 or 100 feet long, as needed or desired. The length of conduit used will depend on the mass flow rate of refrigerant. Conduits of shorter length can be used with refrigerants requiring a smaller mass flow rate. The conduits connecting the different components of the generation refrigerant circuit can have the same or different lengths, as appropriate.

The second refrigerant, used in the generation refrigerant circuit, is generally a lower alkyl hydrocarbon, containing 6 or fewer, e.g., 5 or fewer, 4 or fewer, carbon atoms. In some embodiments, the refrigerant contains one or more heteroatoms. In some embodiments, the second refrigerant is selected from the group consisting of isopentane, pentane, isobutane, butane, propane, and dimethyl ether. In some embodiments, the second refrigerant contains a chlorine or a fluorine atom, although these are calculated to be less efficient. In some embodiments, the second refrigerant is selected from the group consisting of R123 (2,2-dichloro-1,1,1-trifluoroethane; CAS No. 306-83-2), R124 (1-chloro-1,2,2,2-tetrafluoroethane; CAS No. 2837-89-0), R125 (pentafluoroethane; CAS No. 354-33-6), R134a (1,1,1,2-tetrafluoroethane; CAS No. 811-97-2) and R410a (mixture of 50 wt % R32 (difluoromethane; CAS No. 75-10-5) and 50 wt % R125). Other refrigerants that find use in the generation refrigerant circuit include R12, R113, R114, R115, R-502 (Mix of 48.8 wt % R-22/51.2 wt % R-115), R22, R123, R124, R141b, R142b, R225ca, R225cb, R23, R32, R125, R134a, R143a, R152a, R227ea, R236fa, R245ca, R410a (R32/125 (50/50 wt %)), R407c (R32/125/134a (23/25/52 wt %)), R404a (R125/134a/143a (44/4/52 wt %)), R507a (R125/143a (50/50 wt %)), R14 (CF4), R116 (C2F6), 8218 (C3F8), R318 (c-C4F8), sulfur hexafluoride (SF6), R290 (propane), R600a (isobutane), isobutene. In some embodiments, the refrigerant in the generation refrigerant circuit is isobutane.

Energy balance around the generation refrigerant circuit can be expressed by the following equations:

$$W\text{in}2+Q\text{in}2=W\text{out}+Q\text{out}2;\ \text{or}$$

$$W\text{out}=W\text{in}2+Q\text{in}2-Q\text{out}2$$

e. Energy Balance and Efficiency Calculations

To achieve energy balance in the energy storage system, the following equations are satisfied:

1) Qin1=Qout2 (Energy balance around cold sink)
2) Qout1=Qin2 (Energy balance around hot sink)
3) Win1+Qin1=Qout1+Qout1*a* (Energy balance around storage circuit) or Qout1*a*=Win1+Qin1−Qout1
4) Win2+Qin2=Wout+Qout2 (Energy balance around generation circuit) or Wout=Win2+Qin2−Qout2

The storage refrigerant circuit and generation refrigerant circuit can, but need not operate at the same time. The fluids (nominally water with, optionally, some salt) in the cold sink and the hot sink stores thermal energy so that the storage circuit may operate asynchronously from the generation circuit. In some embodiments, the storage refrigerant circuit and the generation refrigerant circuit do not run at the same time. For example, the energy storage system may be configured to receive input electrical energy from a wind turbine, and the storage refrigerant circuit is timed to run during hours of peak wind speeds (e.g., at night); the generation refrigerant circuit can run timed to deliver energy during peak consumption hours, or as demand requires. In another embodiment, the energy storage system may be configured to receive input electrical energy from a photovoltaic unit, and the storage refrigerant circuit is timed to run during hours of peak solar radiation (i.e., daylight hours); again, the generation refrigerant circuit can run timed to deliver energy during peak consumption hours, or as demand requires. In some embodiments, there is at least about an 8 hour delay, for example, at least about a 9, 10, 11, 12, 13, 14, 15, 16 hour delay, between the operation of the storage refrigerant circuit and the generation refrigerant circuit.

The storage circuit could operate between 5 minutes and 12 hours. For example, the storage circuit may operate on an as needed basis, as energy is delivered to the compressor of the storage refrigerant circuit. In some embodiments, the storage refrigerant circuit operates during the time period that energy is delivered above a threshold level (e.g., during times of available or capturable or peak solar radiation or wind energy). In some embodiments, the storage refrigerant circuit operates over a period of 0.2, 0.3, 0.5, 1, 2, 3, 4, 5, 6, 7, 8, 9, 10 or 12 hours. The storage refrigerant circuit can operate continuously or intermittently during this time period.

Capacity in the hot and cold sinks are sufficient to enable discharge through the generation refrigerant circuit at full rated power between, e.g., 1 hour and 12 hours, for example, discharge over 1, 2, 3, 4, 5, 6, 7, 8, 9, 10, 11 or 12 hours. The generation refrigerant circuit can operate continuously or intermittently during this time period. The generation refrigerant circuit drives the expander in such a manner that the output energy is of a quality suitable for use or consumption in an electrical grid. The upper limit for energy storage and discharge is dependent on the practical size of the cold sink and hot sink. In some embodiments, the size of the cold sink or the hot sink is the equivalent of a large oil storage tank. In some embodiments, the cold sink or the hot sink is large fluid reservoir either on the surface or subterranean.

Figure 3A:
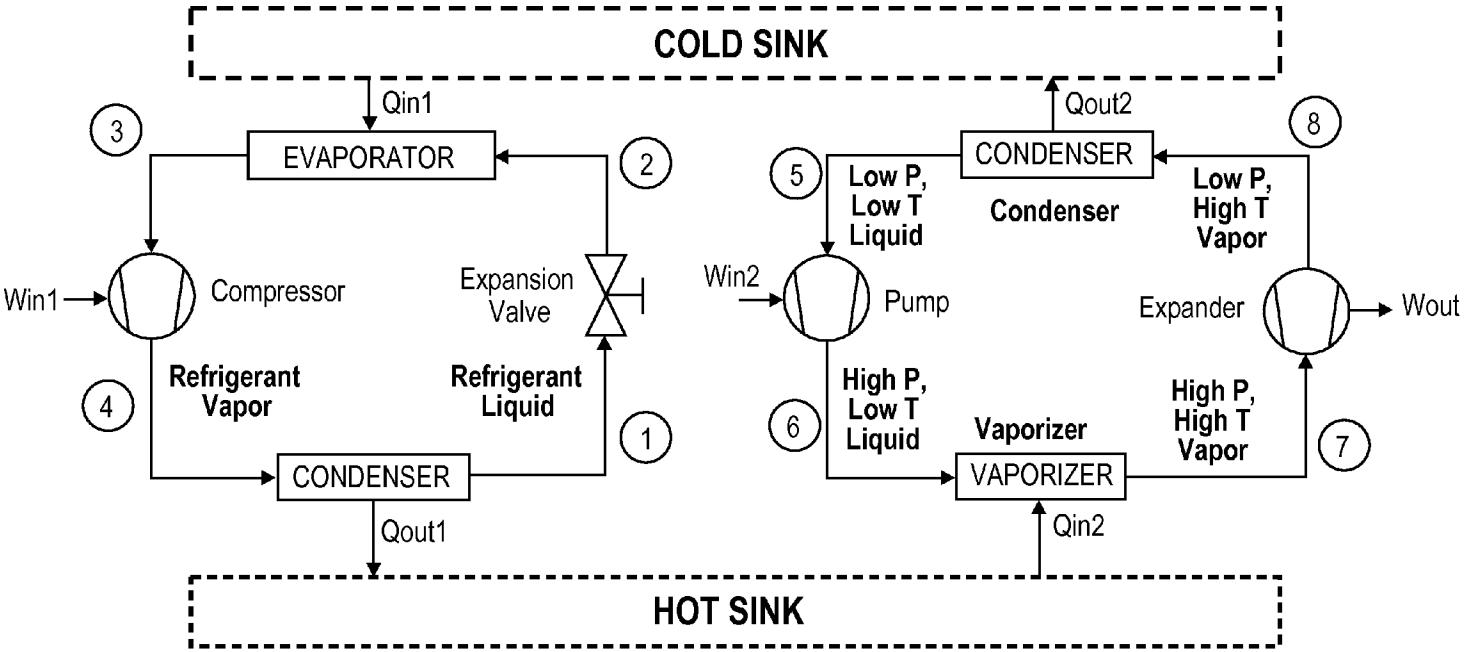
FIG. 3 illustrates a thermodynamic analysis of a baseline process cycle using ammonia as the first refrigerant and isobutane as the second refrigerant.

FIG. 3 provides a thermodynamic spreadsheet of an exemplary embodiment of the present energy storage system. Ammonia is used as the first refrigerant in the storage refrigerant circuit. Isobutane is used as the second refrigerant in the generation refrigerant circuit. The calculations were implemented in Microsoft Excel using NIST (US National Institute of Standards) REFPROP, Version 8.0 DLL (Dynamic Link Library). REFPROP was written by E. W. Lemmon, M. L. Huber, and M. O. McLinden. The software uses NIST Standard Reference Database 23, copyright 2007. The idealized assumptions are as follows:

1) Compressors are ideal (i.e. Delta-s=0).
2) Compressor requires suction refrigerant state to be full vapor (i.e. no liquid).
3) Expander required discharge state to be full vapor (i.e. no liquid).
4) Approach temperatures heat exchangers are small (~2 C.).
5) Maximum compression ratio is in the range of 6×(Pout/Pin) (about the limit for a single stage compressor).
6) There is more heat going to the "hot sink" than can be consumed.

Under the conditions presented in FIG. 3, the theoretical efficiency is approaching 70%. This is in part due to the compression ratios being around 3× and the temperature difference between the hot and cold sink being modest (about 35° C.). The actual efficiency of the compressors can be between 80% and 85% depending on the nature of the machine design and the scale. Larger scale will be more efficient. A theoretical efficiency of about 85% correlates to a practical efficiency of about 50% (2 kW-hr in for 1 kW-hr out). A theoretical efficiency of about 80% correlates to a practical efficiency of about 45%.

The theoretical efficiencies of the present energy storage systems are generally greater than 50%, for example, in the range of about 50-85%, for example, at least about 55%, 60%, 65%, 70%, 75%, 80% or 85% efficient. In some embodiments, the practical efficiency is at least about 30%, for example, at least about 35%, 40%, 45%, 50%, 55% or 60% efficient.

3. Methods of Storing Energy

The invention further provides methods of storing electrical energy using the energy storage systems, as described herein. The methods involve delivering input electrical energy, e.g., from a renewable energy source, to the compressor of the storage refrigerant circuit. The first refrigerant is driven through the storage refrigerant circuit taking heat out of the cold sink, causing the cold sink to freeze, and rejecting heat into the hot sink, where the thermal energy is stored in the hot sink. As energy is needed or desired, the second refrigerant is driven through the generation refrigerant circuit, taking heat from the hot sink to drive the expander to produce output electrical energy. The heat from the generation refrigerant circuit is rejected into the cold sink, causing the cold sink to melt. The embodiments of the methods correspond to what is described herein for the energy storage systems.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference in their entirety for all purposes.

What is claimed is:

1. An energy storage system comprising:

(a) a storage refrigerant circuit that receives input electric power and converts the electric power to stored thermal energy, the storage refrigerant circuit comprising:
  (i) a compressor that receives input electric energy and pumps a first refrigerant through the circuit;
  (ii) a first condenser in fluid communication with the compressor and in thermal communication with a hot sink;
  (iii) a second condenser in fluid communication with the first condenser, wherein the second condenser releases heat sufficient to balance the energy around the hot sink;
  (iv) an expansion valve in fluid communication with the second condenser; and
  (v) an evaporator in fluid communication with the expansion valve and the compressor, and in thermal communication with a cold sink, wherein the cold sink is maintained at a temperature that is less than about 0° C. and that is at least about 20° C. cooler than the hot sink, wherein heat transfer from the cold sink to the evaporator causes the cold sink to freeze, wherein thermal energy from the cold sink is delivered through the storage refrigerant circuit to the hot sink, thereby converting the input electric power to thermal energy stored in the hot sink; and (b) a generation refrigerant circuit that receives stored thermal energy from the hot sink and converts the stored energy to output electric power, the generation refrigerant circuit comprising:
  (i) a pump that pumps a second refrigerant through the circuit;
  (ii) a vaporizer in fluid communication with the pump and in thermal communication with the hot sink;
  (iii) an expander in fluid communication with the vaporizer, wherein the expander produces output electric power; and
  (iv) a condenser in fluid communication with the expander and the pump, and in thermal communication with the cold sink, wherein thermal energy stored in the hot sink is delivered through the generation refrigerant circuit to the cold sink, driving the expander to produce output electric power, wherein heat transfer to the cold sink from the condenser causes the cold sink to melt, thereby converting the stored thermal energy to output electric power.

2. The energy storage device of claim 1, wherein the energy storage system can store at least about 1 megawatt (MW) of thermal energy.

3. The energy storage device of claim 1, wherein the theoretical efficiency is at least about 50%.

4. The energy storage device of claim 1, wherein the storage refrigerant circuit and the generation refrigerant circuit run synchronously.

5. The energy storage device of claim 1, wherein the storage refrigerant circuit and the generation refrigerant circuit run asynchronously.

6. The energy storage device of claim 5, wherein there is at least an 8 hour delay between the running of the storage refrigerant circuit and the running of the generation refrigerant circuit.

7. The energy storage device of claim 1, wherein the cold sink is at least about 30° C. cooler than the hot sink.

8. The energy storage device of claim 1, wherein the cold sink is maintained at about 0° C. and the hot sink is maintained at about 30° C.

9. The energy storage device of claim 1, wherein the cold sink is water.

10. The energy storage device of claim 9, wherein the cold sink is a brine.

11. The energy storage device of claim 1, wherein the hot sink is water.

12. The energy storage device of claim 11, wherein the hot sink is a natural aquifer.

13. The energy storage device of claim 1, wherein the first refrigerant is ammonia.

14. The energy storage device of claim 1, wherein the first refrigerant is pumped through the storage refrigerant circuit at flow rate between about 30,000 kg/hr to about 40,000 kg/hr.

15. The energy storage device of claim 1, wherein the second refrigerant is a lower alkyl hydrocarbon.

16. The energy storage device of claim 15, wherein the second refrigerant is selected from the group consisting of isobutane, propane, butane and dimethyl ether.

17. The energy storage device of claim 1, wherein the second refrigerant is pumped through the generation refrigerant circuit at a flow rate between about 100,000 kg/hr to about 125,000 kg/hr.

18. The energy storage device of claim 1, wherein the first refrigerant is ammonia and the second refrigerant is isobutane.

19. The energy storage device of claim 1, wherein the second condenser in the storage refrigerant circuit releases excess heat into the air.

20. The energy storage device of claim 1, wherein the second condenser in the storage refrigerant circuit releases excess heat into water.

21. The energy storage device of claim 1, wherein the compressor in the storage refrigerant circuit is in communication with a motor powered by an electricity generating source.

22. The energy storage device of claim 21, wherein the electricity generating source is one or more photovoltaic units.

23. The energy storage device of claim 21, wherein the electricity generating source is one or more wind turbines.

24. The energy storage device of claim 1, wherein the expander in the generation refrigerant circuit is in communication with a generator that is in communication with an electrical grid.

25. A method of storing electrical energy, comprising:

(a) delivering electrical energy to a storage refrigerant circuit that receives input electric power and converts the electric power to stored thermal energy, the storage refrigerant circuit comprising:

(i) a compressor that receives input electric energy and pumps a first refrigerant through the circuit;

(ii) a first condenser in fluid communication with the compressor and in thermal communication with a hot sink;

(iii) a second condenser in fluid communication with the first condenser, wherein the second condenser releases heat sufficient to balance the energy around the hot sink;

(iv) an expansion valve in fluid communication with the second condenser; and (v) an evaporator in fluid communication with the expansion valve and the compressor, and in thermal communication with a cold sink, wherein the cold sink is maintained at a temperature that is less than about 0° C. and that is at least about 20° C. cooler than the hot sink, wherein heat transfer from the cold sink to the evaporator causes the cold sink to freeze, wherein thermal energy from the cold sink is delivered through the storage refrigerant circuit to the hot sink, thereby converting the input electric power to thermal energy stored in the hot sink; and (b) delivering the stored thermal energy in the hot sink to a generation refrigerant circuit that receives stored thermal energy from the hot sink and converts the stored energy to output electric power, the generation refrigerant circuit comprising:

(i) a pump that pumps a second refrigerant through the circuit;

(ii) a vaporizer in fluid communication with the pump and in thermal communication with the hot sink;

(iii) an expander in fluid communication with the vaporizer, wherein the expander produces output electric power; and (iv) a condenser in fluid communication with the expander and the pump, and in thermal communication with the cold sink, wherein thermal energy stored in the hot sink is delivered through the generation refrigerant circuit to the cold sink, driving the expander to produce output electric power, wherein heat transfer to the cold sink from the condenser causes the cold sink to melt, thereby converting the stored thermal energy to output electric power.

26. The method of claim 25, wherein at least about 1 megawatt (MW) of thermal energy is stored in the hot sink.

27. The method of claim 25, wherein the theoretical efficiency is at least about 50%.

28. The method of claim 25, wherein the storage refrigerant circuit and the generation refrigerant circuit run synchronously.

29. The method of claim 25, wherein the storage refrigerant circuit and the generation refrigerant circuit run asynchronously.

30. The method of claim 29, wherein there is at least an 8 hour delay between the running of the storage refrigerant circuit and the running of the generation refrigerant circuit.

31. The method of claim 25, wherein the cold sink is at least about 30° C. cooler than the hot sink.

32. The method of claim 25, wherein the cold sink is maintained at about 0° C. and the hot sink is maintained at about 30° C.

33. The method of claim 25, wherein the cold sink is water.

34. The method of claim 33, wherein the cold sink is a brine.

35. The method of claim 25, wherein the hot sink is water.

36. The method of claim 35, wherein the hot sink is a natural aquifer.

37. The method of claim 25, wherein the first refrigerant is ammonia.

38. The method of claim 25, wherein the first refrigerant is pumped through the storage refrigerant circuit at flow rate between about 30,000 kg/hr to about 40,000 kg/hr.

39. The method of claim 25, wherein the second refrigerant is a lower alkyl hydrocarbon.

40. The method of claim 39, wherein the second refrigerant is selected from the group consisting of isobutane, propane, butane and dimethyl ether.

41. The method of claim 25, wherein the second refrigerant is pumped through the generation refrigerant circuit at a flow rate between about 100,000 kg/hr to about 125,000 kg/hr.

42. The method of claim 25, wherein the first refrigerant is ammonia and the second refrigerant is isobutane.

43. The method of claim 25, wherein the second condenser in the storage refrigerant circuit releases excess heat into the air.

44. The method of claim 25, wherein the second condenser in the storage refrigerant circuit releases excess heat into water.

45. The method of claim 25, wherein the compressor in the storage refrigerant circuit is in communication with a motor powered by an electricity generating source.

46. The method of claim 45, wherein the electricity generating source is one or more photovoltaic units.

47. The method of claim 45, wherein the electricity generating source is one or more wind turbines.

48. The method of claim 25, wherein the expander in the generation refrigerant circuit is in communication with a generator that is in communication with an electrical grid.

* * * * *